US010714060B1

(12) United States Patent
Guido

(10) Patent No.: US 10,714,060 B1
(45) Date of Patent: Jul. 14, 2020

(54) GLOVE FOR STRINGED INSTRUMENT

(71) Applicant: Giovanni Guido, Yamato (JP)

(72) Inventor: Giovanni Guido, Yamato (JP)

( * ) Notice: Subject to any disclaimer, the term of this patent is extended or adjusted under 35 U.S.C. 154(b) by 94 days.

(21) Appl. No.: 15/933,067

(22) Filed: Mar. 22, 2018

(51) Int. Cl.
*G10D 3/173* (2020.01)
*A41D 19/00* (2006.01)

(52) U.S. Cl.
CPC ..... *G10D 3/173* (2020.02); *A41D 19/0013* (2013.01); *A41D 19/0024* (2013.01); *A41D 19/0048* (2013.01); *A41D 19/0086* (2013.01)

(58) Field of Classification Search
CPC ..... G10D 3/163; A41D 19/0086; A41D 19/0048; A41D 19/0024; A41D 19/0013
See application file for complete search history.

(56) References Cited

U.S. PATENT DOCUMENTS 1,358,824 A * 11/1920 Burden ..... A41D 19/015 2/163
4,131,952 A * 1/1979 Brenning, Jr. ..... A41D 19/015 2/124
4,907,297 A 3/1990 Gallucci
5,228,142 A * 7/1993 Yoswein-McGreen ..... A61F 13/10 2/159
5,323,677 A * 6/1994 Knutson ..... G10D 3/163 84/322
5,390,371 A 2/1995 Sigward
2007/0175311 A1 8/2007 Sloan
2010/0005563 A1 1/2010 Park
2011/0041225 A1 2/2011 Harvey et al.
2013/0283498 A1* 10/2013 Hewitt ..... A63B 71/141 2/161.1
2014/0189925 A1* 7/2014 Ramirez ..... A41D 19/01547 2/16
2018/0042316 A1* 2/2018 Wiseman ..... A41D 19/0037

OTHER PUBLICATIONS

Nail Gloves. Product listing [online]. © 2018 HalloweenCostumes.com. [Retrieved on Nov. 16, 2017]. <URL:https://www.halloweencostumes.com/nail-gloves.html>.

* cited by examiner

*Primary Examiner* — Khaled Annis
(74) *Attorney, Agent, or Firm* — Cramer Patent & Design, PLLC; Aaron R. Cramer

(57) ABSTRACT

A glove includes a glove body having a resilient plucking device secured at the distal end of each of the glove fingers. The pinky finger portion of the glove is open. The glove has a securement strap about the wrist of the glove.

4 Claims, 4 Drawing Sheets

GLOVE FOR STRINGED INSTRUMENT

RELATED APPLICATIONS

Not applicable.

FIELD OF THE INVENTION

The present invention relates generally to a wearable glove particularly suited when playing a stringed instrument.

BACKGROUND OF THE INVENTION

Guitars are found in all genres of music from country, to jazz, to rock and even contemporary classical music. They produce a pleasing sound that forms the centerpiece of many pieces of music as well as forming a complementary sound on just about all types of music.

One (1) particular style of guitar playing is "fingerstyle" in which the strings are plucked directly with the fingernails as opposed to using a pick. While certainly fun and entertaining to listen to, such playing places a great deal of stress on the fingernails and makes the user trim and maintain their nails in a fashion that many find unaesthetically pleasing. Should a nail become broken, the ability to play becomes impossible.

Accordingly, there exists a need for a means by which a fingerstyle guitar playing can be performed without reliance on one's own nails. The development of the glove for playing a stringed instrument fulfills this need.

SUMMARY OF THE INVENTION

The principles of the present invention provide for such a glove, to include a glove body having a palmate side, a distal side, a palm cuff area, a distal cuff area, and a wrist opening adjacent the palm cuff area and distal cuff area. A thumb sleeve protrudes away from the glove body opposite the wrist opening; has a thumb pick affixed to a distal end. An index sleeve protrudes away from the glove body opposite the wrist opening, having an index pick affixed to a distal end. A middle sleeve protrudes away from the glove body opposite the wrist opening, having a middle pick affixed to a distal end. A ring sleeve protrudes away from the glove body opposite the wrist opening, having a ring pick affixed to a distal end. A pinky sleeve is truncated immediately above the glove body. In certain embodiments, each pick is affixed to a distal side of a respective sleeve.

It is a further object of the present invention to provide a thumb air vent located adjacent the thumb pick, an index air vent located adjacent the index pick, a middle air vent located adjacent the middle pick, and a ring air vent located adjacent the ring pick.

It is another object of the present invention to provide a securement aid located on the glove body for removably fastening said glove to a user. In at least one (1) embodiment, the securement aid is a flap located on the distal side having a first fastener, capable of removable fastening to a second fastener located on the distal side. In an embodiment, a bifurcated portion is located on the distal end, extending upward from the distal cuff area and terminating subjacent to the pinky sleeve. The flap is located on a first side of the bifurcated portion and the second fastener of the distal side is located on a second side of the bifurcated portion.

It is still another object of the present invention to provide a glove body manufactured out of a material providing a tight restrictive fit. Further the glove body can have multiple ventilation holes disposed about the distal side.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
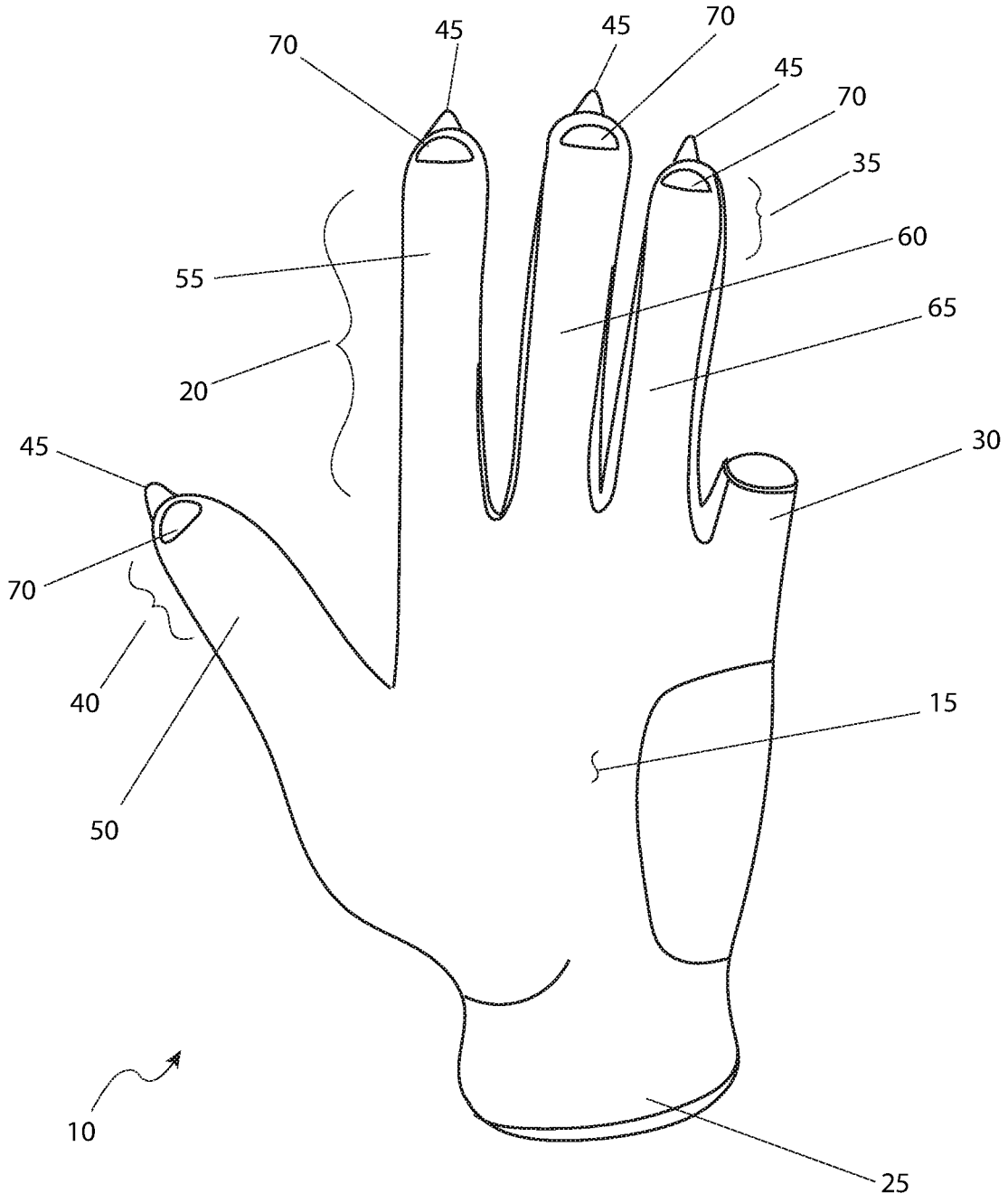
FIG. 1 is a front view of the glove 10, according to the preferred embodiment of the present invention.

10 glove
11 bifurcated portion
15 palm area
20 finger area
25 palm cuff area
30 fingerless pinky
35 finger tip
40 thumb tip
45 pick protrusion
50 thumb
55 index finger
60 middle finger
65 ring finger
70 air vent
75 back area
80 back cuff area
85 securement aid
90 ventilation holes
95 fastening method
100 user
105 stringed instrument
110 hand
115 strings

DETAILED DESCRIPTION OF THE PREFERRED EMBODIMENT

The best mode for carrying out the invention is presented in terms of its preferred embodiment, herein depicted within FIGS. 1 through 4. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

Referring now to FIG. 1, a front view of the glove 10 for playing a stringed instrument 105, according to the preferred embodiment of the present invention is disclosed. The glove 10 includes of many of the same components as found in a pair of conventional gloves. The glove 10 itself is of a thin, lightweight, and form fitting, similar in nature to gloves used for golfing, driving, or batting in baseball. It is envisioned that the glove 10 would be made in multiple sizes such as small, medium, large, and extra-large to fit all sizes of users, and would also be made available in multiple colors and styles to suit all tastes. The front view or palm side view discloses a palm area 15, a finger area 20, and a palm cuff area 25. The glove 10 is shown with a fingerless pinky 30 for purposes of illustration, however the presence or lack of a fingerless pinky 30 is not intended to be a limiting factor of the present invention. It is envisioned that the glove 10 would be made in both left- and right-hand versions to allow use for both right- and left-handed users. It is intended that only one (1) glove 10 would be worn on the hand used to strum or pick the stringed instrument. The textile material used to construct the glove 10 would be lightweight in nature. Materials of construction would include leather, nylon, neoprene, spandex, or the like provided a tight restrictive fit is provided, especially at the fingertip 35 and the thumb tip 40.

A pick protrusion 45 is provided at the end of the thumb 50, the index finger 55, the middle finger 60 and the ring finger 65. The pick protrusion 45 function as a pick, permanently attached to the glove 10 so that the user may play a stringed instrument in a manner similar to that of a hand-held pick or with the use of one's fingernails in a finger pick style of play. Further description of the pick protrusion 45 will be provided herein below. An air vent 70 is provided immediately below each pick protrusion 45 to provide air flow to the user's fingers and thumb, and to provide an increased sense of tactile feedback when playing a stringed instrument with the glove 10.

Figure 2:
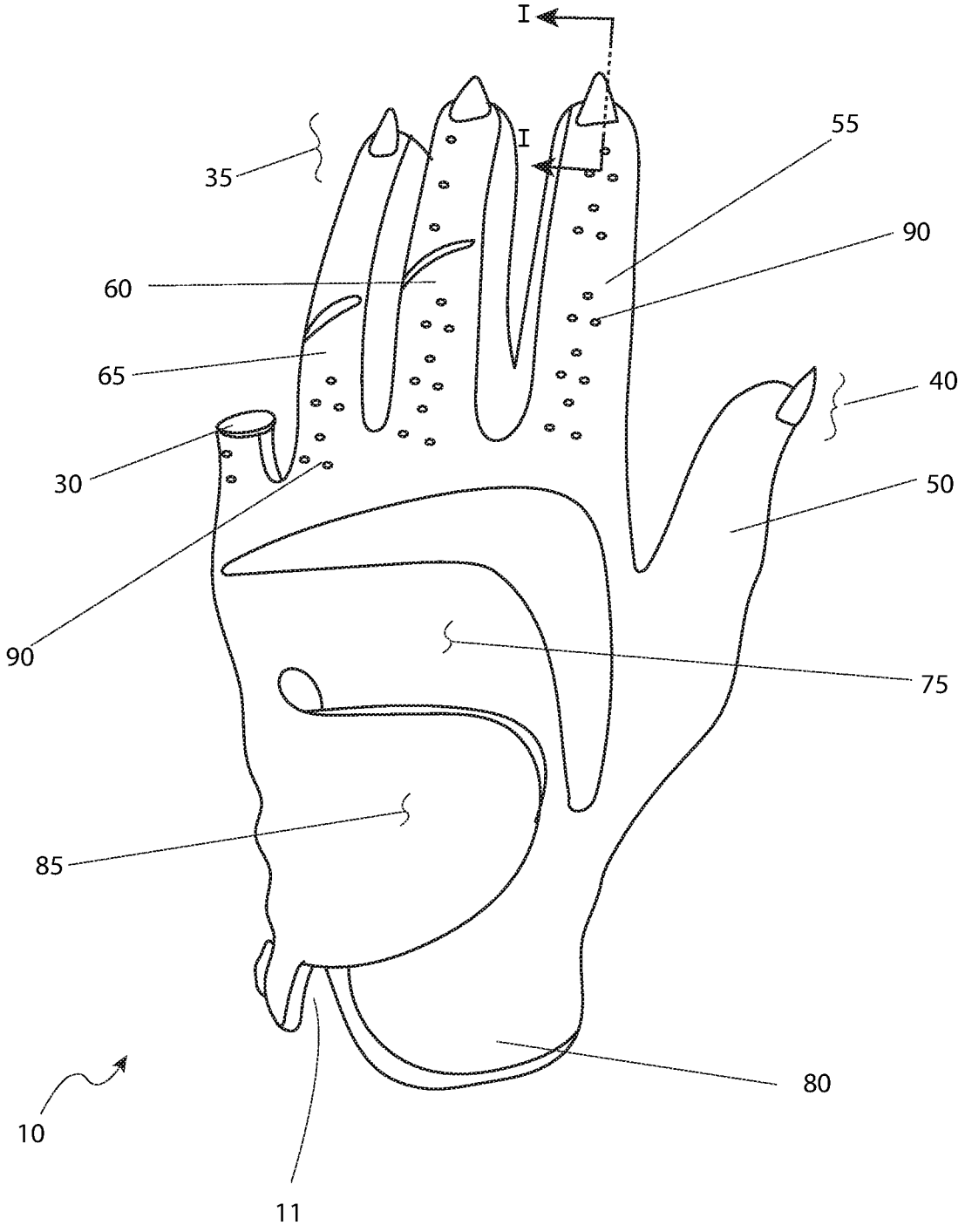
FIG. 2 is a rear view of the glove 10, according to the preferred embodiment of the present invention.

Referring next to FIG. 2, a rear view of the glove 10, according to the preferred embodiment of the present invention is depicted. This view depicts a back area 75 and back cuff area 80 as would normally be expected of a conventional glove. Additionally, a securement aid 85 and multiple ventilation holes 90 are also present, although such items are necessary to the functionality of the glove 10. Thus, the inclusion or exclusion of the securement aid 85 and the ventilation holes 90 is not intended to be a limiting factor of the present invention. The securement aid 85, if utilized, would aid in firmly attaching the glove 10 to the user's hand and prevent movement of the glove 10 on the hand which could negatively impact utilization and resulting sound quality. Such a securement aid 85 could comprise a flap of the glove body, either on the palm area 15 or the back area 75, having a first fastener on it, capable of removably coupling to a second fastener located on the back area 75. An illustrated embodiment of the securement aid 85 includes a flap portion of the back area 75 subjacent the pinkyless finger 30 capable of removable securement to the second fastener located on the back area 75 located generally in a central location adjacent the back cuff area 80. The glove has a bifurcated portion 11 extending upward from the back cuff area 80 towards the pinkyless finger 30. The flap with the first fastener is on a first side of the bifurcated portion 11 and the portion of the back area 75 with second fastener is on the second side of the bifurcated portion 11. The first fastener and second fastener could be corresponding halves of a hook-and-loop-type fastener.

The pick protrusions 45 are attached to the respective rear surface of the fingertip 35 on the index finger 55, the middle finger 60 and the ring finger 65, as well as the thumb tip 40 on the thumb 50. Such placement locates the pick protrusion 45 directly over the user's respective nails when their hand is in the glove 10 and thus functions as an extension or enhancement to their natural nails.

Figure 3:
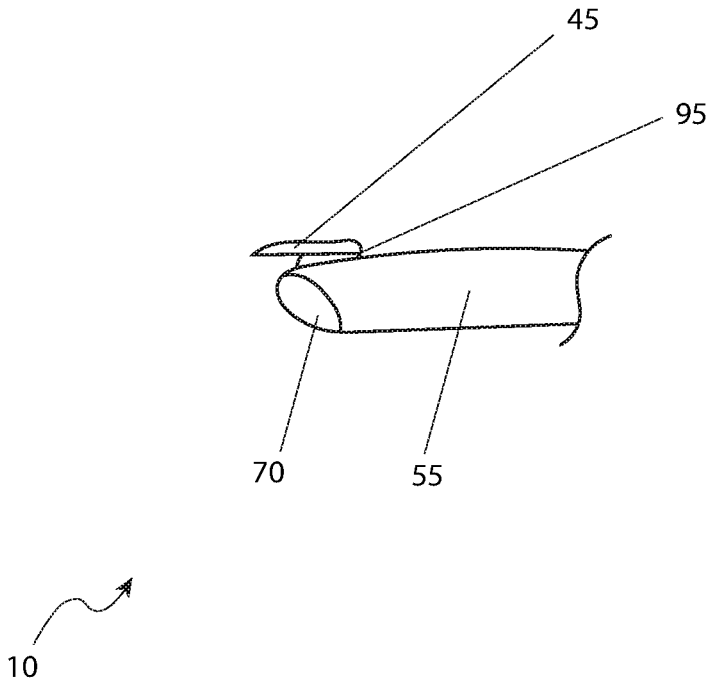
FIG. 3 is a sectional view of the glove 10, as seen along a line I-I, as shown in FIG. 2, according to the preferred embodiment of the present invention; and, FIG. 4 is a perspective view of the glove 10, shown in a utilized state, according to the preferred embodiment of the present invention.

Referring now to FIG. 3, a sectional view of the glove 10, as seen along a line I-I, as shown in FIG. 2, according to the preferred embodiment of the present invention is shown. This view provides an internal view of the construction of the glove 10 in the area of the index finger 55. The air vent 70 is visible at the distal end of the index finger 55 while the pick protrusion 45 is positioned directly above. The pick protrusion 45 is attached to the glove 10 by use of a fastening method 95. The fastening method 95 as shown in FIG. 3 is that of an adhesive such as glue, epoxy, or the like. However, other fastening method 95 such as a mechanical strap which encompasses the fingertip 35 (as shown in FIG. 1), a mechanical fastener through the upper surface of the fingertip 35 (as shown in FIG. 1), such as a rivet, or other method, may be utilized with equal success. As such, the use of any particular type or method of fastening method 95 is not intended to be a limiting factor of the present invention.

Figure 4:
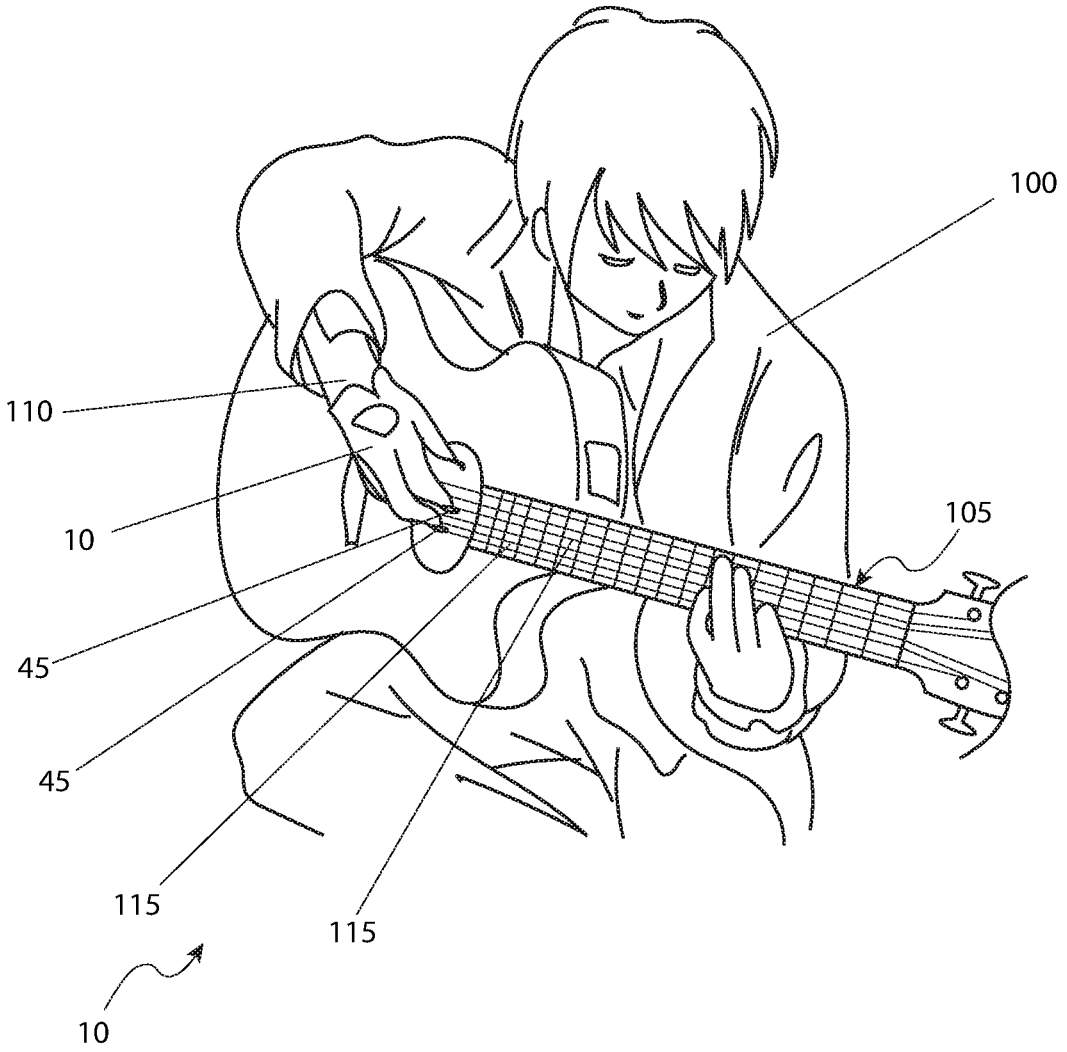

Referring to FIG. 4, a perspective view of the glove 10, shown in a utilized state, according to the preferred embodiment of the present invention is disclosed. A user 100 is utilizing the functionality of the glove 10 to aid in the playing of a stringed instrument 105. For the purposes of illustration, the stringed instrument 105 is depicted as an acoustic guitar. However, other types of stringed instruments may be utilized with the glove 10, and as such, the use of any particular type of stringed instrument 105 is not intended to be a limiting factor of the present invention. The glove 10 is employed on the hand 110 used to strum or pick the strings 115 of the stringed instrument 105. As such, the pick protrusion 45 make direct precise contact in a method that applies pressure to the strings 115 and then releases them in sudden manner to produce the desired sound. This functionality may be used to play a stringed instrument 105 using the "fingerstyle" method of plucking without reliance on the user's actual nails. Thus, the functionality allows the user to maintain their own natural fingernails in a preferred fashion but eliminates the need to apply the gluing of external false nails thus eliminating the risk of nail fungus and other fingertip abnormalities and diseases.

The preferred embodiment of the present invention can be utilized by the common user in a simple and effortless manner with little or no training. It is envisioned that the glove 10 would be constructed in general accordance with FIG. 1 through FIG. 4. The user would procure the glove 10 through normal procurement channels while paying particular attention to left- or right-hand version, size, color, and style.

After procurement and prior to utilization, the glove 10 would be prepared in the following manner: the user 100 would apply the glove 10 to the hand 110 used to strum or pick the stringed instrument 105 in a conventional manner by pulling it on; the securement aid 85, if provided, would be securely fastened; each pick protrusion 45 would be positioned by hand to ensure that it is in a proper position to carefully mimic the nails of the hand 110 inside of the glove 10.

During utilization of the glove 10, the following procedure would be initiated: the user 100 would play the stringed instrument 105 in a conventional manner using their preferred method of playing such as either strumming or picking using the pick protrusion 45 as either a pick or an extension/replacement of their natural nails. This playing/performance continues as required until complete.

After use of the glove 10, it is simply removed and stored until needed again in a cyclical manner.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A stringed instrument glove, comprising a stringed instrument:

a glove body having a palmate side, a distal side, a palm cuff area, a distal cuff area, and a wrist opening adjacent said palm cuff area and said distal cuff area;

a thumb sleeve protruding away from said glove body opposite said wrist opening, said thumb sleeve having a thumb pick affixed to a distal end and a thumb air vent located adjacent said thumb pick;

an index sleeve protruding away from said glove body opposite said wrist opening, said index sleeve having an index pick affixed to a distal end and an index air vent located adjacent said index pick;

a middle sleeve protruding away from said glove body opposite said wrist opening, said middle sleeve having a middle pick affixed to a distal end and a middle air vent located adjacent said middle pick;

a ring sleeve protruding away from said glove body opposite said wrist opening, said ring sleeve having a ring pick affixed to a distal end of each of said ring sleeves and a ring air vent located adjacent said ring pick;

a fingerless pinky sleeve;

a securement aid located on said glove body for removably fastening said glove to a user; and a bifurcated portion located on said distal end, extending upward from said distal cuff area and terminating subjacent to said pinky sleeve;

wherein each said pick is affixed to a distal side of a respective sleeve; and wherein said glove further comprises multiple ventilation holes disposed about said distal side thereof.

2. The stringed instrument glove of claim 1, wherein said glove body further comprising a material providing a tight restrictive fit.

3. A stringed instrument glove, comprising a stringed instrument:

a glove body having a palmate side, a distal side, a palm cuff area, a distal cuff area, and a wrist opening adjacent said palm cuff area and said distal cuff area;

a thumb sleeve protruding away from said glove body opposite said wrist opening, said thumb sleeve having a thumb pick affixed to a distal end;

an index sleeve protruding away from said glove body opposite said wrist opening, said index sleeve having an index pick affixed to a distal end;

a middle sleeve protruding away from said glove body opposite said wrist opening, said middle sleeve having a middle pick affixed to a distal end;

a ring sleeve protruding away from said glove body opposite said wrist opening, said ring sleeve having a ring pick affixed to a distal end;

a fingerless pinky sleeve;

a securement aid located on said glove body for removably fastening said glove to a user; and a bifurcated portion located on said distal end, extending upward from said distal cuff area and terminating subjacent to said pinky sleeve;

a bifurcated portion located on said distal end, extending upward from said distal cuff area and terminating subjacent to said pinky sleeve;

wherein each said pick is affixed to a distal side of a respective sleeve; and wherein said glove further comprises multiple ventilation holes disposed about an outside portion of distal side of a respective sleeve.

4. The stringed instrument glove of claim 3, wherein said glove body further comprising a material providing a tight restrictive fit.

* * * * *